US008087132B2

(12) United States Patent
Forrest et al.

(10) Patent No.: US 8,087,132 B2
(45) Date of Patent: Jan. 3, 2012

(54) VESSEL FOR INTERRING CREMATED REMAINS AND ASSOCIATED METHODS

(76) Inventors: George G. Forrest, Leonardtown, MD (US); Martha Elizabeth Rankin, Menifee, CA (US)

( * ) Notice: Subject to any disclaimer, the term of this patent is extended or adjusted under 35 U.S.C. 154(b) by 0 days.

(21) Appl. No.: 13/023,069

(22) Filed: Feb. 8, 2011

(65) Prior Publication Data

US 2011/0191993 A1 Aug. 11, 2011

Related U.S. Application Data

(60) Provisional application No. 61/337,585, filed on Feb. 8, 2010.

(51) Int. Cl.
*A61G 17/00* (2006.01)

(52) U.S. Cl. ..... 27/1

(58) Field of Classification Search ..... 27/1, 26, 27/27, 35; D99/5; 220/475, 495.06, 552, 220/555; 211/85.27; 40/124.5, 725; 296/16, 296/18; 294/15

See application file for complete search history.

(56) References Cited

U.S. PATENT DOCUMENTS

| | | | | |
|---|---|---|---|---|
| 5,134,758 | A | 8/1992 | Christensen | |
| 5,729,921 | A | 3/1998 | Rojas | |
| 5,815,897 | A | 10/1998 | Longstreth | |
| 6,254,152 | B1 * | 7/2001 | Tillett | 294/15 |
| 6,389,664 | B1 | 5/2002 | Wood et al. | |
| 6,393,679 | B1 * | 5/2002 | Ascheman | 27/32 |
| 6,944,921 | B1 * | 9/2005 | Gersten | 27/1 |
| 7,117,570 | B1 * | 10/2006 | Borgerding | 27/1 |
| 7,421,765 | B1 | 9/2008 | Kaiser | |
| 7,475,457 | B1 * | 1/2009 | Gersten | 27/1 |
| 7,478,461 | B2 | 1/2009 | Glass | |
| 7,621,575 | B1 * | 11/2009 | Kellerman | 296/16 |
| 2003/0024089 | A1 * | 2/2003 | Dziekonski | 27/1 |
| 2005/0125973 | A1 | 6/2005 | Hankel et al. | |
| 2009/0178594 | A1 * | 7/2009 | Fremming | 108/50.11 |

* cited by examiner

*Primary Examiner* — William L. Miller

(74) *Attorney, Agent, or Firm* — Mark R. Malek, Esq.; Eugene R. Quinn, Jr. Esq.; Zies Widerman & Malek

(57) ABSTRACT

A cremated remains containment vessel may include an outer shell including a base and sidewalls extending upwardly from the base. The sidewalls may be defined by a lower portion positioned adjacent the base and an upper portion positioned opposite the base. The outer shell may also include a plurality of interior walls extending upwardly from the base, interior the sidewalls, to define a plurality of compartments. The vessel may also include a top that is removeably connected to the upper portion of the sidewalls, and a pair of handles connected to the sidewalls of the outer shell to oppose one another. The vessel may further include a pair of grooves formed in a bottom portion of the base and aligned substantially parallel with one another. The vessel may still further include a liner carried by the outer shell adjacent an inner portion of the sidewalls and the base, and a data plate carried by a bottom portion of the top. The vessel may also include a frame member carried by an outer portion of the sidewalls. Contact between the top and the outer shell may form an airtight or watertight seal.

17 Claims, 5 Drawing Sheets

VESSEL FOR INTERRING CREMATED REMAINS AND ASSOCIATED METHODS

RELATED APPLICATIONS

The present application claims the benefit of U.S. Provisional Patent Application Ser. No. 61/337,585, titled Vessel for Interring Cremated Remains filed by the inventor of the present application on Feb. 8, 2010, the entire contents of which are incorporated herein by reference.

FIELD OF THE INVENTION

The present invention relates generally to the field of cremation and, more specifically, to a vessel for preserving cremated remains, and associated methods.

BACKGROUND OF THE INVENTION

Currently there are a number of solutions for interring human remains. Some of these solutions include casket interments. These solutions, however, are unable to meet some of the needs of the industry because not all individuals interested in casket burials are able to afford the type and look of the casket they desire for their loved ones. Other solutions attempt to provide alternatives to casket interments. Such alternatives include urns and vaults that store cremated remains. However, these solutions similarly fail to meet some of the needs of the industry and suffer from a variety of drawbacks related to design and cost.

One of the problems with the current state of the art that has been recognized is that existing urns and vaults are difficult to handle, particularly when lowering the vault into a grave during an interment, or when raising the vault from the ground during a disinterment. Still other solutions seek to make up for cost-related deficiencies by providing financial solutions, such as payment plans or credit cards, but these solutions also fail to meet industry needs because many funeral homes have difficulty collecting payment after the interment is complete, or families are left with untold financial problems when settling funeral expenses.

U.S. Pat. No. 7,421,765 to Kaiser discloses a weatherproof cremation urn and burial vault. The urn and vault are hermetically sealed closures made of rigid polyfoam plastic cores covered with aggregate coatings. Included are decorative interior liners, exterior handles, religious inscriptions and identification plaques. In a first aspect, the burial vault and urn are adapted to be displayed during a memorial service and stored below ground. In a second aspect, the vault and urn are adapted to rest above ground at a grave site, in a garden or in a columbarium.

There exists a need to provide a vault for cremated remains that can be placed in a crypt or burial chamber, in or above the ground. Furthermore, it would also be desirable to have an inexpensive alternative to casketed burials. There is also a need to provide individuals a safe, private and waterproof means of interring cremated remains with memorabilia. It would also be desirable to have a vault that does not suffer the stability problems of known solutions. Therefore, there currently exists a need in the industry for a cremation vault or urn that does not suffer the deficiencies of known solutions.

SUMMARY OF THE INVENTION

With the foregoing in mind, the invention is related to a burial cremation vessel that holds cremated remains and can advantageously be added and removed from an internment.

The vessel can also advantageously be used by funeral homes and cemeteries as a less expensive way to provide burial services with dignity. The vessel further advantageously includes a plurality of compartments to store cremated remains, as well as other items, and provides a watertight and/or airtight seal to preserve contents. The vessel is advantageously made of a material that is non-biodegradable.

These and other objects, features, and advantages according to the present invention are provided by a cremated remains containment vessel that includes an outer shell having a base, and sidewalls extending upwardly from the base. The sidewalls are defined by a lower portion positioned adjacent the base and an upper portion positioned opposite the lower portion. The outer shell may include a plurality of interior walls that extend upwardly from the base, interior to the sidewalls. The plurality of interior walls define a plurality of compartments carried by the outer shell. The cremated remains containment vessel may also include a top that can be removeably connected to the upper portion of the sidewalls.

A pair of handles may be connected to the sidewalls of the outer shell and oriented to oppose one another. A pair of grooves may be formed in the bottom portion of the base and may be aligned substantially parallel with one another. Each of the pair of grooves may extend from a first end of an outer peripheral portion of the bottom portion of the base to a second end of the outer peripheral portion of the bottom portion of the base. The pair of grooves are advantageously adapted to receive ropes, for example, so that the cremated remains containment vessel may be readily raised and lowered into a burial site.

The cremated remains containment vessel may also include a liner carried by the outer shell adjacent an inner portion of the sidewalls and the base. A data plate may be carried by a bottom portion of the top, and a frame member may be carried by an outer portion of the sidewalls. Contact between the top and outer shell may form an airtight seal and/or a watertight seal to advantageously preserve the contents of the cremated remains containment vessel.

A top liner may be carried by the top to advantageously allow for a customized appearance of the cremated remains containment vessel. The liner and the top liner may be made of fabric, paper, or cardboard. The outer shell and the top may be made of treated wood, concrete, polyethylene, or any other non-biodegradable material. The top may include an upper portion and a lower portion that threadably connects to the upper portion. The lower portion may define a top compartment that can advantageously used to store other items. The lower portion of the top may include a base and sidewalls that extend upwardly therefrom. The data plate may be carried by the base of the lower portion of the top.

DETAILED DESCRIPTION OF THE PREFERRED EMBODIMENT

The present invention will now be described fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art will realize that the following embodiments of the present invention are only illustrative and are not intended to be limiting in any way. Other embodiments of the present invention will readily suggest themselves to such skilled persons having the benefit of this disclosure.

Referring now to FIGS. 1-14, a cremated remains containment vessel 10 according to the present invention is now described in greater detail. Throughout this disclosure, the cremated remains containment vessel 10 may also be referred to as vessel, vault, or containment vessel. Alternate references of the cremated remains containment vessel 10 in this disclosure are not meant to be limiting in any way.

Figure 1:
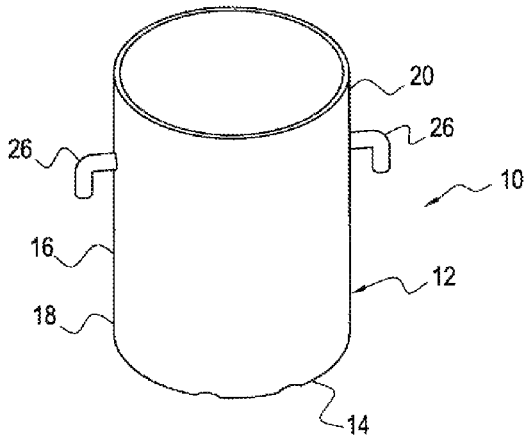
FIG. 1 is a front perspective view of a cremated remains containment vessel according to the present invention.

As perhaps best illustrated in FIG. 1, the vessel 10 according to an embodiment of the present invention includes an outer shell 12. The outer shell 12 includes a base 14 and sidewalls 16 extending upwardly from the base. The sidewalls 16 may be defined as having a lower portion 18 positioned adjacent the base 14, and an upper portion 20 positioned opposite the base. As will be discussed in greater detail below, and as perhaps best illustrated in FIGS. 7-10, the outer shell may include a plurality of interior walls 22 that extend upwardly from the base 14 to form a plurality of compartments within the outer shell.

Figure 2:
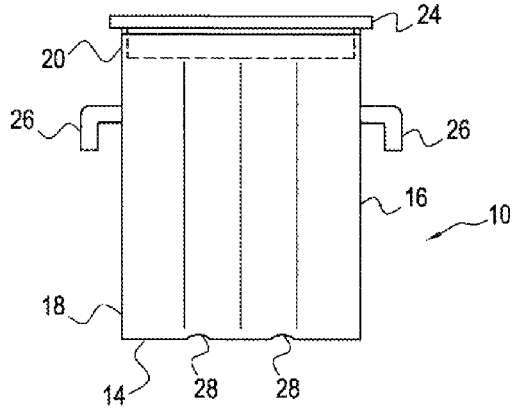
FIG. 2 is a front elevation view of a cremated remains containment vessel according to the present invention.
Figure 3:
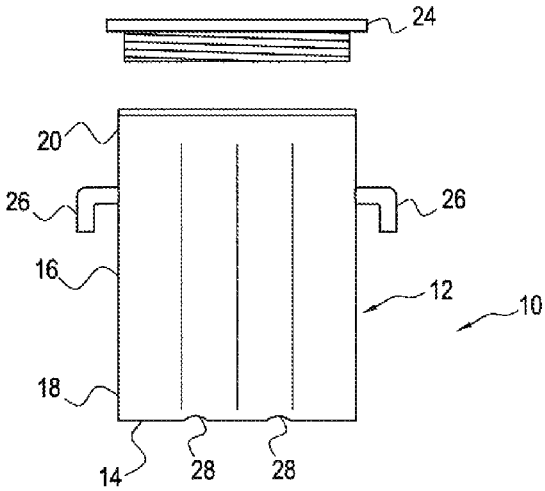
FIG. 3 is an exploded front elevation view of the cremated remains containment vessel illustrated in FIG. 2.

Referring now additionally to FIGS. 2-3, additional features of the vessel 10 according to an embodiment of the present invention are now described in greater detail. More specifically, the vessel 10 may include a top 24 that is removeably connected to the upper portion 20 of the sidewalls 16. A pair of handles 26 may illustratively be connected to the sidewalls 16 of the outer shell 12 of the vessel 10. More specifically, each of the pair of handles 26 are preferably positioned to oppose one another to advantageously allow the vessel 10 to be readily carried and moved in a balanced manner. Although illustrated as having a substantially L shape, each of the handles 26 may, for example, be winged shaped. Further, interior portions of each handle 26 may advantageously be curved and have a smooth finish to also enhance stability when lifting and moving the vessel 10.

Those skilled in the art will appreciate that the handles 26 may be connected to the sidewalls 16 of the outer shell 12 of the vessel 10 according to an embodiment of the present invention by any number of known connections. For example, each of the handles 26 may be welded to the sidewalls 16 of the outer shell 12, or a fastener may be used to connect each of the handles to the sidewalls. Further, after having had the benefit of reading this disclosure, those skilled in the art will appreciate that the vessel 10 according to an embodiment of the present invention contemplates that the handles 26 may be integrally formed with the sidewalls 16 of the outer shell 12 as a monolithic unit. Connection of the handles 26 to the sidewalls 16 may be dependent upon the type of material that the outer shell 12 is made of.

Figure 4:
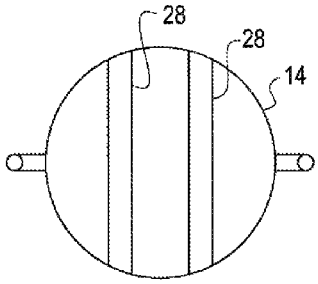
FIG. 4 is a bottom plan view of the cremated remains containment vessel illustrated in FIG. 2.

As further illustrated in FIGS. 2-4, the base 14 of the outer shell 12 may include a pair of grooves 28 formed therein. Each of the pair of grooves 28 are preferably aligned substantially parallel with one another. Further, and as perhaps best illustrated in FIG. 4, each of the pair of grooves extends from a first end of an outer peripheral portion of the bottom portion of the base 14 to a second end of the outer peripheral portion of the bottom portion of the base. In other words, although each of the grooves does not extend the full diameter of the bottom portion of the base 14, the grooves do substantially extend from end to end of the base. As perhaps best illustrated in FIGS. 2-3, each of the grooves 28 formed in the base 14 of the outer shell extend upwardly into the lower portion 18 of the sidewalls 16 of the outer shell. The grooves 28 formed in the base 14 of the outer shell 12 are advantageously adapted to receive raising/lowering members so that the vessel 10 may be readily raised and lowered into an internment site, i.e., the final resting place of the cremated remains to be stored within the vessel. Those skilled in the art will appreciate that raising/lowering members may, for example, be ropes, straps, or any other elongated member that may be used to engage the vessel 10 and, more specifically, the grooves 28 formed in the base 14, to readily raise and lower the vessel into the internment site.

Figure 13:
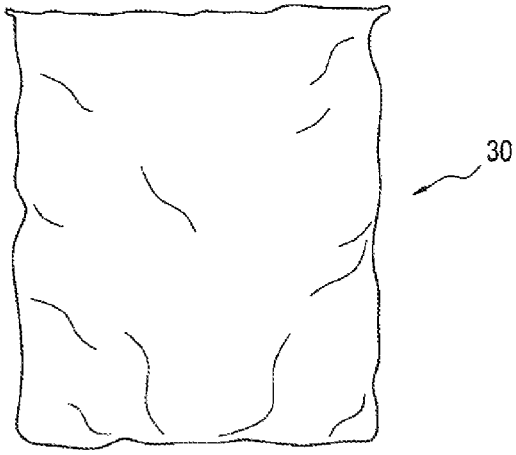
FIG. 13 is a perspective view of a liner to be carried by the outer shell of the cremated remains containment vessel according to the present invention.
Figure 14:
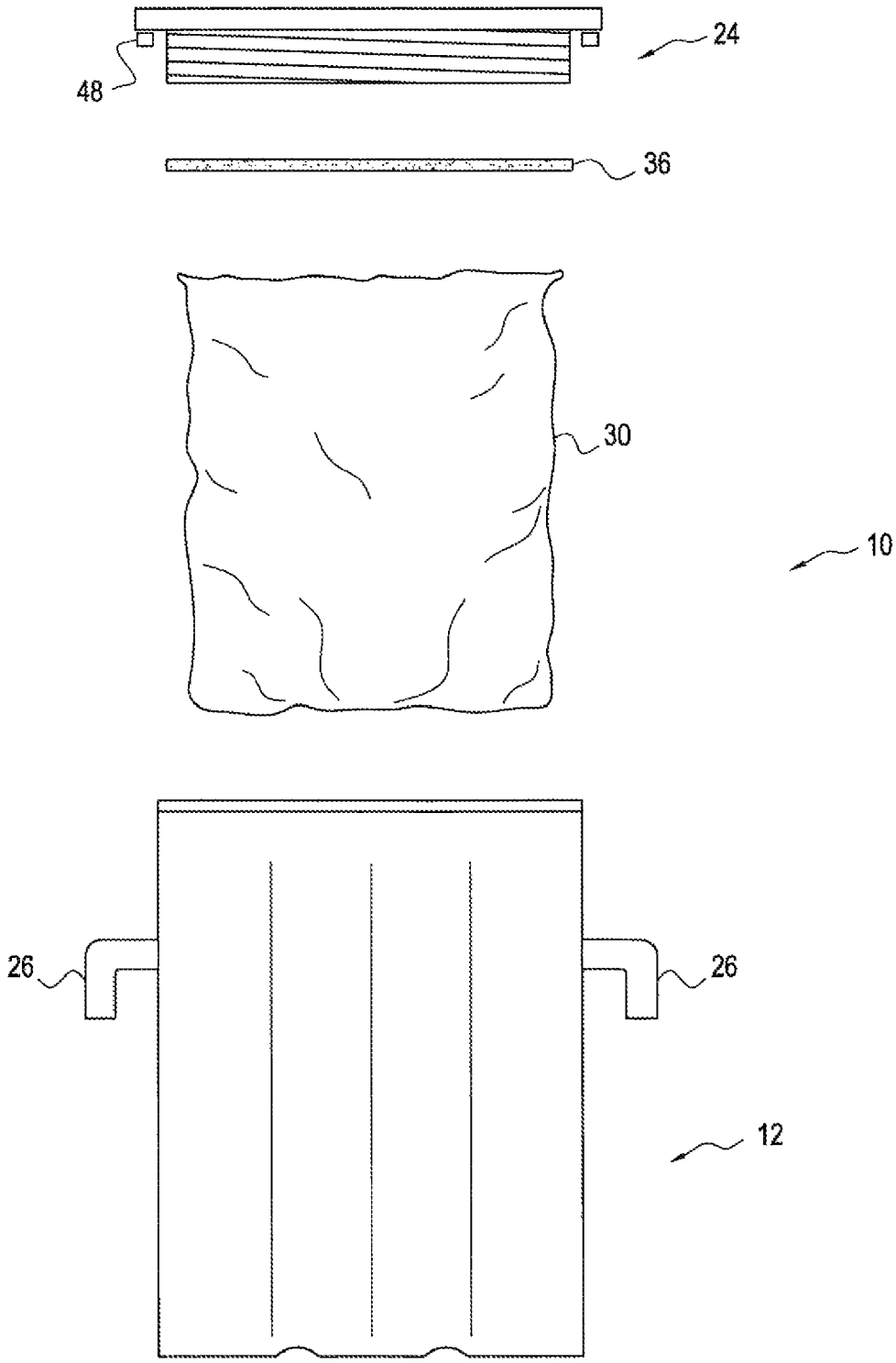
FIG. 14 is an exploded view of the cremated remains containment vessel according to the present invention showing the outer shell, the liner, and the top.

Referring now additionally to FIGS. 13-14, other features of the vessel 10 according to an embodiment of the present invention are now described in greater detail. More specifically, FIG. 13 illustrates a liner 30 to be carried by the outer shell 12 adjacent an inner portion of the sidewalls 16 and the base 14. More specifically, the liner 30 may be adapted to be positioned within the outer shell 12 to advantageously provide a customized appearance to the vessel 10 as may be desired. The liner 30 is illustrated in FIG. 14 in an exploded view of the vessel 10 as being inserted into the outer shell 12. Those skilled in the art will appreciate, however, after having had the benefit of this disclosure, that the liner 30 may be fixed within the outer shell 12 by any number of methods, such as, for example, an adhesive.

The present invention contemplates that the liner 30 may be positioned to line the complete interior of the outer shell 12. Further, it is contemplated that in the embodiments of the vessel 10 that include a plurality of compartments 46, as will be discussed in greater detail below, and as illustrated in FIGS. 7-10, the liner 30 may be positioned to line, or cover, all of the compartments including the base and walls of each of the compartments 46. After having the benefit of this disclosure, those skilled in the art will also appreciate that the liner 30 may be positioned to cover only portions of the interior of the outer shell 12 as may be desired.

As also illustrated in FIG. 14, the vessel 10 according to an embodiment of the present invention may also include a top liner 36 that may be carried by the top 24. It is preferred that the top liner 36 matches the liner 30, but those skilled in the art will appreciate that the present invention contemplates a top liner that may differ from the liner. The top liner may be secured to a bottom portion of the top 24 by any number of ways, such as, for example, an adhesive. The liner 30 and the top liner 36 may, for example, be made of any number of materials. It is contemplated that both the liner 30 and the top liner 36 may be made of a fabric material, a paper material, or a cardboard material. Those skilled in the art will appreciate, however, after having had the benefit of this disclosure, that any other type of decorative material is contemplated for use as the liner 30 and the top liner 36 of the vessel 10 according to an embodiment of the present invention.

As perhaps best illustrated in FIG. 14, contact between the top 24 and the outer shell 12 preferably forms an airtight seal and/or a watertight seal. This may advantageously be provided by a seal 48 between the top 24 and an upper portion 20 of the sidewalls 16 of the outer shell 12. The seal 48 may, for example, be provided by a gasket type of seal, and is preferably carried by the top 24. The seal 48 may be connected to the top 24 using an adhesive, but those skilled in the art will appreciate that any other connection between the seal and the top is contemplated by the present invention. More specifically, and for exemplary purposes only, it is contemplated that a bottom portion of the top 24 may include a groove formed therein to receive the seal 48 so that the seal may be positioned to sit flush with a bottom portion of the top 24 within the groove. The seal 48 between the top 24 and the outer shell 12 may, for example, be provided by a neoprene material, or any other type of material having similar elastic properties to prevent intrusion of air and/or water into the outer shell 12 of the vessel 10 according to the present invention.

Figure 5:
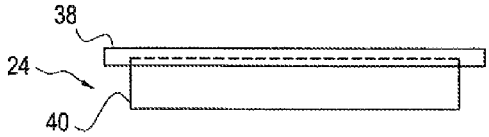
FIG. 5 is a front elevation view of a top of the cremated remains containment vessel illustrated in FIG. 2.
Figure 11:
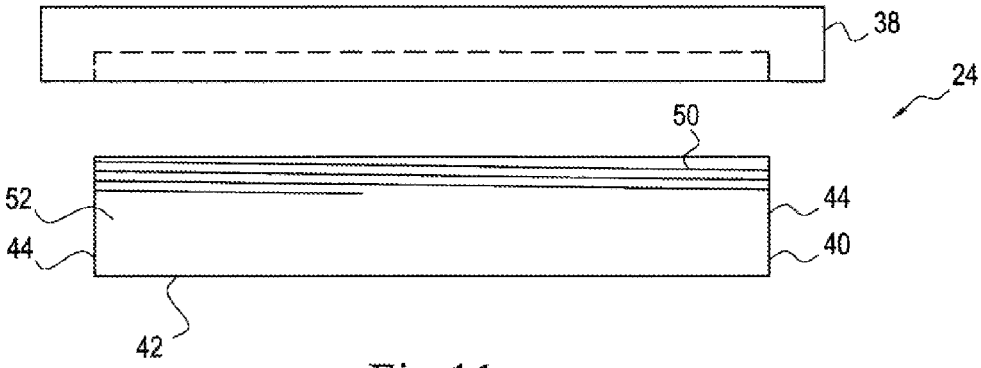
FIG. 11 is an exploded view of an embodiment of the top of the cremated remains containment vessel according to the present invention.
Figure 12:
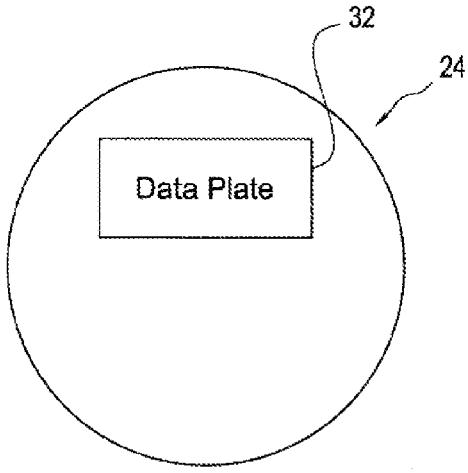
FIG. 12 is a bottom schematic view of the top of the cremated remains containment vessel illustrated in FIG. 2

Referring now additionally to FIGS. 5 and 11-12, additional features of the vessel 10 according to embodiments of the present invention are now described in greater detail. More specifically, FIGS. 5 and 11-12 illustrate the top 24 of the vessel 10 according to embodiments of the present invention. The top 24 may include a lower portion 40 and an upper portion 38. In some embodiments, the upper portion 38 and lower portion 40 of the top 24 may be integrally formed as a monolithic unit, i.e., a one-piece top. In such an embodiment, it is contemplated that the lower portion 40 of the top 24 may be threaded to threadably connect the top to the outer shell 12. More specifically, it is contemplated that interior portions of the sidewalls 16 of the outer shell 12 may be threaded to receive the threaded portion of the top 24 so that the connection between the top and the outer shell is airtight and/or watertight. As indicated above, a seal 48 may be provided to enhance the connection between the top 24 and the outer shell 12. A threaded connection between the top 24 and the outer shell 12 is not the only contemplated connection. More particularly, it is contemplated that any other type of connection may be made between the top 24 and the outer shell 12. For example, the top 24 may be hingedly connected to the outer shell 12, or matingly connected to the outer shell, or connected to the outer shell by any other type of connection that may become apparent to a skilled artisan after having the benefit of this disclosure.

In other embodiments, the upper portion 38 and the lower portion 40 of the top 24 may be provided by separate pieces that matingly connect with one another. More specifically, and as perhaps best illustrated in FIG. 11, the bottom portion 40 of the top 24 may threadably engage the upper portion 38 of the top 24. The lower portion 40 of the top 24 may be defined by a base 42 and sidewalls 44 extending upwardly from the base. The sidewalls 44 of the lower portion 40 of the top 24 include lower sidewalls and upper sidewalls. The upper sidewalls may include threads 50 that may threadably engage the upper portion 38 of the top 24. More specifically, an interior portion of the upper portion 38 of the top 24 may be threaded to receive the threads 50 on the sidewalls 44 of the lower portion 40 of the top.

Accordingly, interior portions of the lower portion 40 of the top 24 may define a top compartment 52 within which various items may be selectively stored. For example, a loved one may wish to include a keepsake to be stored within the vessel 10 relating to the deceased. These may include, for example, pictures, jewelry, or any other type of keepsake as understood by those skilled in the art. The keepsake may be positioned within the top compartment 52 which may then be closed by threadably connecting the lower portion 40 of the top 24 to the upper portion 38 of the top. It is contemplated that the top compartment 52 may also include a liner, and that a seal may be provided between the lower portion 40 of the top and the upper portion 38 of the top to provide an airtight/watertight seal.

As perhaps best illustrated in FIG. 12, the vessel 10 according to an embodiment of the present invention may also include a data plate 32 that is preferably carried by a bottom portion of the top 24. The data plate 32 may be connected to the top 24 by an adhesive. Those skilled in the art will appreciate, however, after having the benefit of reading this disclosure, that the data plate 32 may be secured to the top using in any number of ways as well. The date plate 32 may, for example, be engraved to include the name of the deceased whose cremated remains are stored within the vessel 10, along with, or as well as, any other information that is desired to be stored thereon. The data plate 32 may also include any other information that may be desired by the loved ones of the deceased to be displayed. The data plate 32 may be made of any number of materials, i.e., metal, fabric, cardboard, or any other type of material suitable for receiving information to be displayed thereon.

It is also contemplated that the data plate 32 may be an electronic device that is affixed to a bottom portion of the top 24. More specifically, the electronic device of the data plate 32 may be a data storage device that is also adapted to emit a signal. The signal may, for example, include information relating to the deceased, or any other type of information as may be desired. For example, the data plate 32 may include a biography of the deceased and, perhaps, notes by loved ones to be stored thereon. This may be especially advantageous for families and loved ones that prefer to track family trees and other historical data. Further, the data plate 32 may also be useful to cemeteries and funeral homes to provide, for example, location data directed to the position of the vessel 10. Any other data that is desired to be stored on an electronic data plate 32 is also contemplated by the present invention.

The data plate 32 illustrated in FIG. 12 is positioned on a bottom portion of the top 24 so that the data plate is positioned inside the vessel 10 when the top is secured to the outer shell 12. The data plate 32 may also be positioned to a top portion of the top 24, or may be connected to any portion of the vessel 10 to be readily viewable when the top is secured to the outer shell 12. The data plate 32 may also be positioned adjacent a bottom portion of the base 14 of the outer shell 12. Further, and referring back to FIGS. 5 and 11, it is contemplated that the data plate 32 may advantageously be used with any embodiment of the top 24, i.e., one piece top or two piece top.

Figure 6:
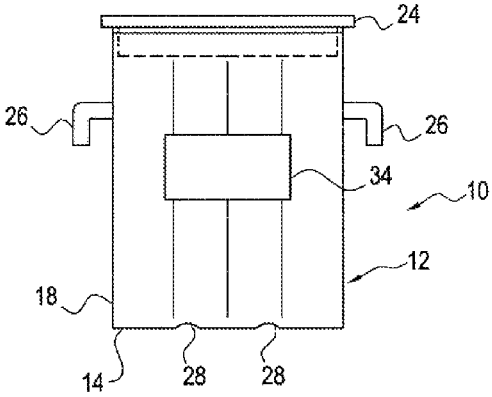
FIG. 6 is a front elevation view of the cremated remains containment vessel according to the present invention showing a frame carried by a sidewall of an outer shell thereof.

Referring now to FIG. 6, yet another feature of the vessel 10 according to an embodiment of the present invention is now described in greater detail. As illustrated, the vessel 10 may include a frame member 34 carried by the sidewalls 16 of the outer shell 12. More specifically, the frame member 24 is preferably carried by an outer portion of the sidewalls 16 of the outer shell 12. The frame member 34 may be adapted to receive information regarding the deceased whose cremated remains are contained within the vessel 10 such as, for example, a picture or other keepsake item that may be desired to be displayed on an outer portion of the vessel 10 by the loved ones. The frame member 34 may, for example, provide a sealed pocket to contain any item that is desired to be displayed, or an open pocket. Further, the frame member 34 may allow for insertion of the desired item to be displayed through the top, bottom, or sides thereof. The frame member 34 may include a framed portion adjacent an outer peripheral portions thereof, and a window portion carried by the frame portion. The window portion may, for example, include a film to protect that which is to be inserted therein. The film may, for example, be any type of material including, but not limited to, a plastic material, a glass material, or any other material that may substantially cover that which is to be positioned within the frame while still allowing for that which is to be positioned within the frame to be viewed.

Referring now additional to FIGS. 7-10, other features of the vessel 10 according to embodiments of the present invention are now described in greater detail. FIGS. 7-10 illustrate a plurality of compartments 46 formed within the outer shell 12 of the vessel. The compartments 46 are formed by interior walls 22 positioned within the outer shell 12 of the vessel 10. More specifically, the interior walls 22 extend upwardly from an interior portion of the base 14 of the outer shell 12. As illustrated in each of FIGS. 7-10, the compartments 46 may have different sizes, and the interior walls 22 that form the compartments may extend both horizontally and vertically within the outer shell 12 of the vessel 10 according to the present invention.

Figure 7:
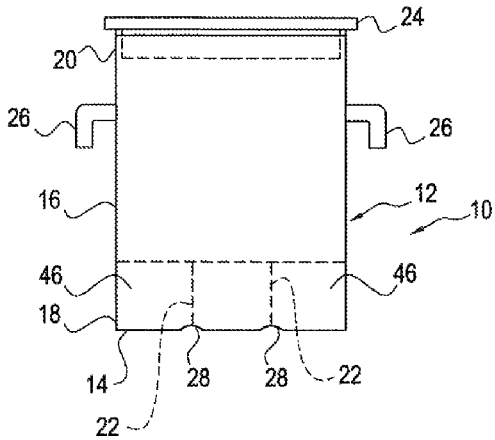
FIGS. 7-10 are front elevation views of embodiments of the cremated remains containment vessel wherein the dotted lines illustrate compartments formed within the outer shell thereof.
Figure 8:
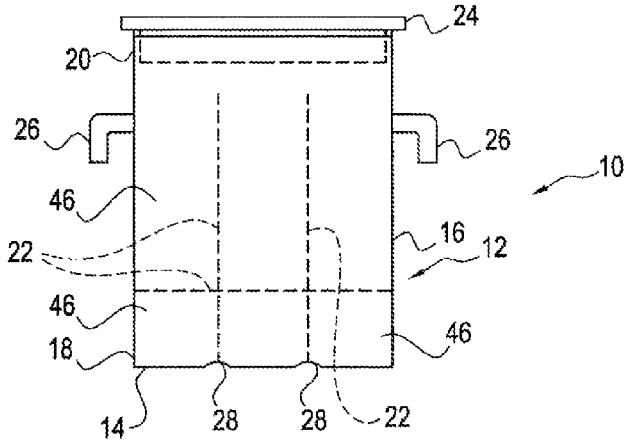
Figure 9:
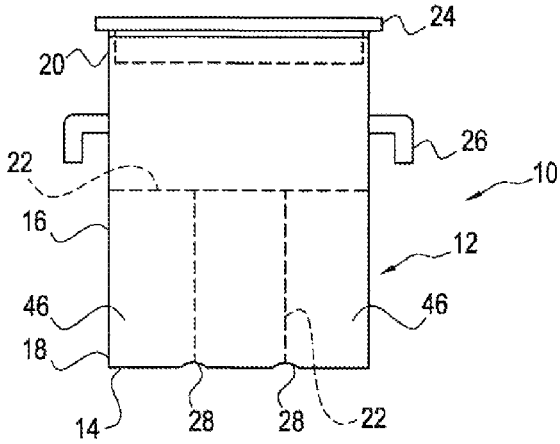
Figure 10:
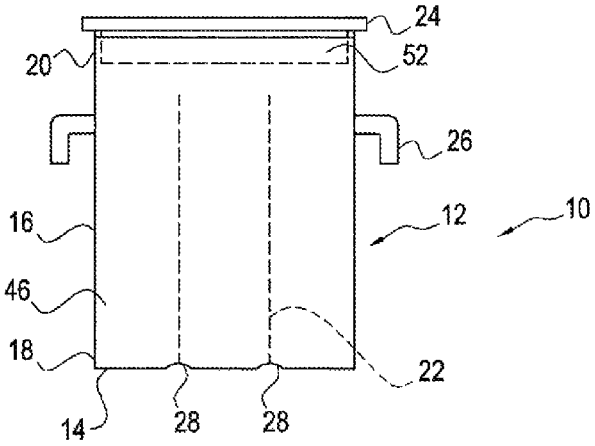

For example, the compartments 46 illustrated in FIG. 7 extend upwardly from the base 14 approximately one-quarter of the way up the interior portion of the outer shell 12. The compartments 46 illustrated in FIG. 8 are divided into lower compartments and upper compartments separated by a horizontally positioned interior wall 22. Further, the compartments 46 illustrated in the vessel 10 of FIG. 8 include upper compartments that extend substantially the height of an interior portion of the outer shell 12. The compartments 46 illustrated in FIG. 9 extend approximately one-half of the height of an interior portion of the outer shell 12 and include a horizontally positioned interior wall 22 that may, for example, act as a shelf within the outer shell 12 so that other items may be positioned thereon. The configuration of the compartments illustrated in FIG. 10 is simplistic and the interior walls 22 act as dividers to provide three distinct compartments 46 within the outer shell 12. The configurations illustrated in FIGS. 7-10 are exemplary in nature and not meant to limit the scope of the present invention.

Although the vessel 10, according to embodiments of the present invention, is illustrated in the appended figures as being substantially cylindrical and having a substantially circular top, the present invention contemplates that the vessel 10 may have any shape. For example, the outer shell 12 may have a substantially polygonal shape, and the top 24 may also have a polygonal shape. Any shape is contemplated for the base 14 and outer shell 12 of the vessel 10, as well as for the top 24 of the vessel. Those skilled in the art will also appreciate, after having the benefit of reading this disclosure, that the vessel 10 may include a plurality of different shapes. For example, the base 14 of the outer shell 12 may have a first shape, e.g., polygonal, and the sidewalls 16 of the outer shell may have another shape, e.g., substantially cylindrical, and extend upwardly from the polygonally shaped base. Further, the top 24 may have a lower portion 40 that is cylindrical to matingly engage the sidewalls 16 of the outer shell 12 and an upper portion 38 that has a different shape, e.g., polygonal.

The vessel 10 is preferably made of a non-biodegradable material. More specifically, the outer shell 12 and top 24 are preferably made of treated wood, concrete, polyethylene, or any other type of biodegradable material as understood by those skilled in the art.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed.

That which is claimed is:

1. A cremated remains containment vessel comprising:

an outer shell including a base and sidewalls extending upwardly from the base, the sidewalls being defined by a lower portion positioned adjacent the base and an upper portion positioned opposite the base, the outer shell including a plurality of interior walls extending upwardly from the base to define a plurality of compartments; and a top that is removeably connected to the upper portion of the sidewalls;

a pair of handles connected to the sidewalls of the outer shell to oppose one another;

a pair of grooves formed in a bottom portion of the base and aligned substantially parallel with one another, each of the pair of grooves extending from a first end of an outer peripheral portion of the bottom portion of the base to a second end of the outer peripheral portion of the bottom portion of the base, the grooves adapted to receive raising/lowering members to raise and lower the vessel into an interment site;

a liner carried by the outer shell adjacent to an inner portion of the sidewalls and the base;

a data plate carried by a lower portion of the top; and at least one frame member carried by an outer portion of the sidewalls;

wherein contact between the top and outer shell forms at least one of an airtight seal and a watertight seal.

2. A cremated remains containment vessel according to claim 1 further comprising a top liner carried by the top.

3. A cremated remains containment vessel according to claim 2 wherein the liner and the top liner is at least one of fabric, paper, and cardboard.

4. A cremated remains containment vessel according to claim 1 wherein the outer shell and top are at least on of treated wood, concrete and polyethylene.

5. A cremated remains containment vessel according to claim 1 wherein the outer shell is a non-biodegradable material.

6. A cremated remains containment vessel according to claim 1 wherein the top includes an upper portion and the lower portion that threadably connects to the upper portion of the outer shell; and wherein the lower portion of the top defines a top compartment.

7. A cremated remains containment vessel according to claim 6 wherein the lower portion of the top includes a base and sidewalls extending upwardly therefrom; and wherein the data plate is carried by the base of the lower portion of the top.

8. A cremated remains containment vessel comprising:

an outer shell including a base and sidewalls extending upwardly from the base, the sidewalls being defined by a lower portion positioned adjacent the base and an upper portion positioned opposite the base; and a top that is removeably connected to the upper portion of the sidewalls;

a pair of handles connected to the sidewalls of the outer shell to oppose one another;

a pair of grooves formed in a bottom portion of the base and aligned substantially parallel with one another, each of the pair of grooves extending from a first end of an outer peripheral portion of the bottom portion of the base to a second end of the outer peripheral portion of the bottom portion of the base, the grooves adapted to receive raising/lowering members to raise and lower the vessel into an interment site;

a data plate carried by a lower portion of the top;

a liner carried by the outer shell; and a top liner carried by the lower portion of the top.

9. A cremated remains containment vessel according to claim 8 wherein the liner is carried adjacent an inner portion of the sidewalls and the base.

10. A cremated remains containment vessel according to claim 8 wherein contact between the top and the outer shell forms at least one of an airtight seal and a watertight seal.

11. A cremated remains containment vessel according to claim 8 wherein the liner and the top liner is at least on of fabric, paper, and cardboard.

12. A cremated remains containment vessel according to claim 8 wherein the outer shell and the top are at least one of treated wood, concrete, polyethylene.

13. A cremated remains containment vessel according to claim 8 wherein the outer shell is a non-biodegradable material.

14. A cremated remains containment vessel according to claim 8 wherein the outer shell includes at least one interior wall extending upwardly from the base interior to define at least one compartment within the outer shell.

15. A cremated remains containment vessel according to claim 8 further comprising at least one frame member carried by an outer portion of the sidewalls.

16. A cremated remains containment vessel according to claim 8 wherein the top includes an upper portion and the lower portion that threadably connects to the upper portion of the outer shell; and wherein the lower portion of the top defines a top compartment.

17. A cremated remains containment vessel according to claim 16 wherein the lower portion of the top includes a base and sidewalls extending upwardly therefrom; and wherein the data plate is carried by the base of the lower portion of the top.

* * * * *